US006203106B1

(12) United States Patent
Nearing et al.

(10) Patent No.: US 6,203,106 B1
(45) Date of Patent: Mar. 20, 2001

(54) CHAIR FOR HANDICAPPED INDIVIDUALS

(75) Inventors: Charles H. Nearing; Gary F. Meyers; Jeffrey A. Gunderson, all of Redwood Falls, MN (US)

(73) Assignee: Activeaid, Inc., Redwood Falls, MN (US)

( * ) Notice: Subject to any disclaimer, the term of this patent is extended or adjusted under 35 U.S.C. 154(b) by 0 days.

(21) Appl. No.: 09/312,921

(22) Filed: May 17, 1999

(51) Int. Cl.[7] ..... A47C 1/035

(52) U.S. Cl. ..... 297/329; 297/284.9; 297/411.29; 297/411.31; 297/466; 297/DIG. 4

(58) Field of Search ..... 297/284.9, 325, 297/329, 411.29, 411.34, 411.31, 411.37, 423.34, 423.35, 423.37, 423.38, 464, 466, DIG. 4

(56) References Cited

U.S. PATENT DOCUMENTS

| | | | | |
|---|---|---|---|---|
| 2,102,979 | | 12/1937 | Smith . | |
| 2,153,763 | * | 4/1939 | Kuhler | 297/329 |
| 2,858,876 | * | 11/1958 | Woodson, Jr. | 297/411.34 |
| 3,012,776 | | 12/1961 | Hotas . | |
| 3,189,385 | * | 6/1965 | Mommsen | 297/423.38 X |
| 3,901,527 | * | 8/1975 | Danzinger et al. | 297/411.34 X |
| 3,950,026 | * | 4/1976 | Van Seenus | 297/411.37 X |
| 4,383,714 | * | 5/1983 | Ishida | 297/325 |
| 4,732,423 | * | 3/1988 | Condon | 297/302.6 X |
| 4,941,709 | | 7/1990 | Moller . | |
| 5,050,899 | | 9/1991 | Stensby . | |
| 5,249,838 | | 10/1993 | Kulpa et al. . | |
| 5,320,416 | | 6/1994 | Kornberg . | |
| 5,407,248 | * | 4/1995 | Jay et al. | 297/284.9 X |
| 5,601,519 | | 2/1997 | Comereski . | |
| 5,624,159 | | 4/1997 | Celoni et al. . | |
| 5,678,267 | | 10/1997 | Kinder . | |
| 5,785,384 | | 7/1998 | Sagstuen . | |
| 5,799,964 | | 9/1998 | Chao . | |
| 5,967,609 | * | 10/1999 | Potter | 297/325 |
| 6,106,065 | * | 8/2000 | Carroll | 297/325 X |

* cited by examiner

*Primary Examiner*—Peter R. Brown
(74) *Attorney, Agent, or Firm*—R. C. Baker & Associates, Ltd.

(57) ABSTRACT

The chair for handicapped individuals has an undercarriage with a descending and ascending track system, and a tiltable assembly equipped with track followers for riding the descending and ascending track system of the undercarriage. A brake shiftable between a locked condition for holding the tiltable assembly against movement on the track system and an unlocked condition for allowing movement of it on the track system is provided. The tiltable assembly includes a seat assembly and an adjustable hip-limiting assembly at each lateral side of the seat assembly, plus a back assembly pivotally mounted to the seat assembly and an adjustable leg assembly mounted at each lateral side of the seat assembly. No power assistance is required to accomplish tilting of the tiltable assembly or any adjustment of any feature of the chair. The variety of chairs incorporating features of the invention include shower and commode chairs.

40 Claims, 6 Drawing Sheets

CHAIR FOR HANDICAPPED INDIVIDUALS

BACKGROUND OF THE INVENTION

This invention relates to a chair for handicapped individuals, and more particularly to a versatile chair having a variety of adjustable features, especially those that can be accomplished by a care-giver without power assistance. Within the ambit of the invention are invalid chairs for general use as well as those for shower use and those for commode use. One of the more striking features of the invention is the special way for accomplishing easy tilting of a chair structure.

Tiltable chair structures have been on the market for many years, generally with hydraulic, pneumatic, or electrical power assist elements. Whether with or without power assist elements, all heretofore known tiltable chairs have lacked simplified water-shedding or drying design features that are important for shower use. Simplicity for structural elements and their relationship to each other hasn't seemed to have been a dominant consideration in the design of known tiltable and adjustable chairs for the handicapped. Conveniently adjustable hip help in a chair for a handicapped person hasn't received major attention.

A long-standing need has thus existed for a chair for the handicapped capable of a variety of adjustments for patient comfort and positioning without requiring complicated power-assist mechanisms, while at the same time having the total simplicity of structure as needed for shower and commode use, for easy cleaning, and for care-giver convenience in handling handicapped individuals, especially those with severe handicaps.

SUMMARY OF THE INVENTION

A major teaching of this invention is that of a new type of tiltable chair for handicapped individuals. Illustratively, the tiltable chair has an undercarriage and a track system at each lateral side. On the undercarriage is a tiltable seat assembly equipped with track followers that support the tiltable assembly for tilting movement on the track systems of the undercarriage. The track systems of the undercarriage ideally are rail-like in character, and the track followers ideally comprise a roller and holder combination, wherein the roller rides above and the holder below the rails of the track systems.

Tilting action is achieved by employing track systems that have a different slope for the rear and front parts along each lateral side. The rear tracks have a descending slope and the front tracks have an ascending slope. The rear descending and the front ascending slope contribute to gravity assistance for tilting of the tiltable assembly. Tilting is readily accomplished without any power-assist elements and with surprising ease of effort.

Holding the tiltable assembly against movement on the undercarriage is accomplished by a brake system or systems and the most preferred is mounted on the undercarriage and shiftable between a locked braking condition and an unlocked non-braking condition through a linkage extending to a location on the tiltable assembly.

An advantageous feature of the invention is a hip-limiting assembly for guidance or support at the hip of a handicapped individual occupying the chair. Appropriate adjustment of the hip-limiting assembly on each lateral side of the seat of the chair helps to maintain even a severely handicapped person at a proper sitting location on the chair. The preferred assembly on each side includes a foundation member, a hip pad, and an adjustable link between the foundation member and the hip pad for varying the angle and distance between them.

A suitable back assembly for a chair of the invention is one pivotably mounted to the seat assembly for tilting into a variety of angular relationships with respect to the seat assembly. Ideally the tilting of the tiltable assembly and the pivoting of the back assembly permit the option of an essentially horizontal orientation for the back assembly. Preferred elements of the back assembly include a frame, a back support adjustable with respect to the frame, suitable padding removably mountable on the back support, and adjustable arm rests capable of being shifted from normal lateral side positions to inoperable positions removed from the side.

Adding leg assemblies to the chair preferably is done by mounting them for pivot action at the forward or front part of lateral sides of the seat assembly of the chair. Each leg assembly preferably has a base leg rod on which is mounted a foot rest and a calf support, both of which preferably are adjustable.

Chairs having features for commode use require a seat assembly having a hole through it and generally also include a removable collection pan underneath. Chairs for shower bathing of the handicapped also are provided by the invention.

Many other advantageous features and benefits of the invention will be evident as this description proceeds.

DETAILED DESCRIPTION OF THE INVENTION

Figure 1:
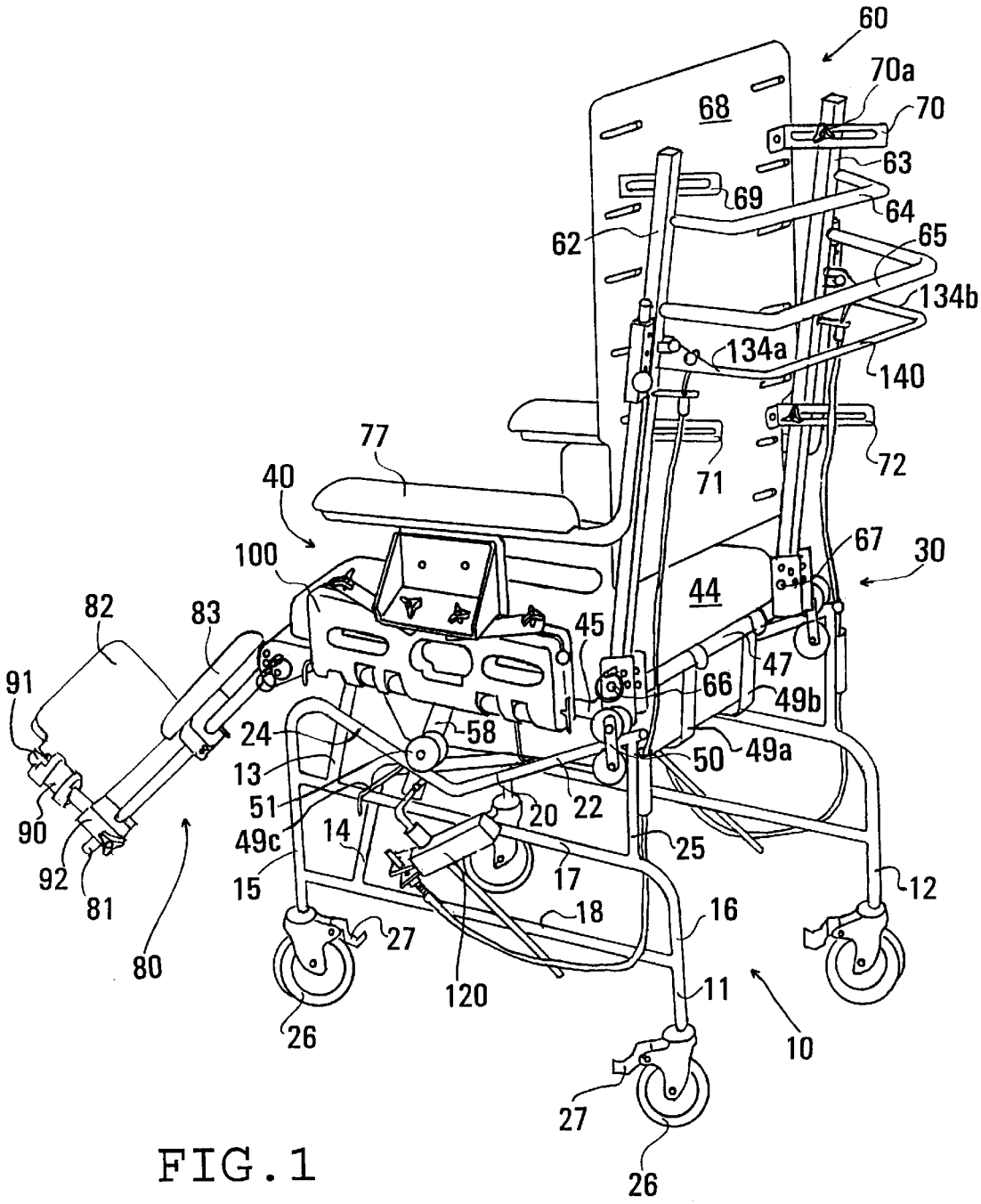
FIG. 1 is a schematic perspective view of a chair according to the invention, with only the left leg assembly included in the view (the removed right leg assembly being a mirror image of the left)
Figure 2:
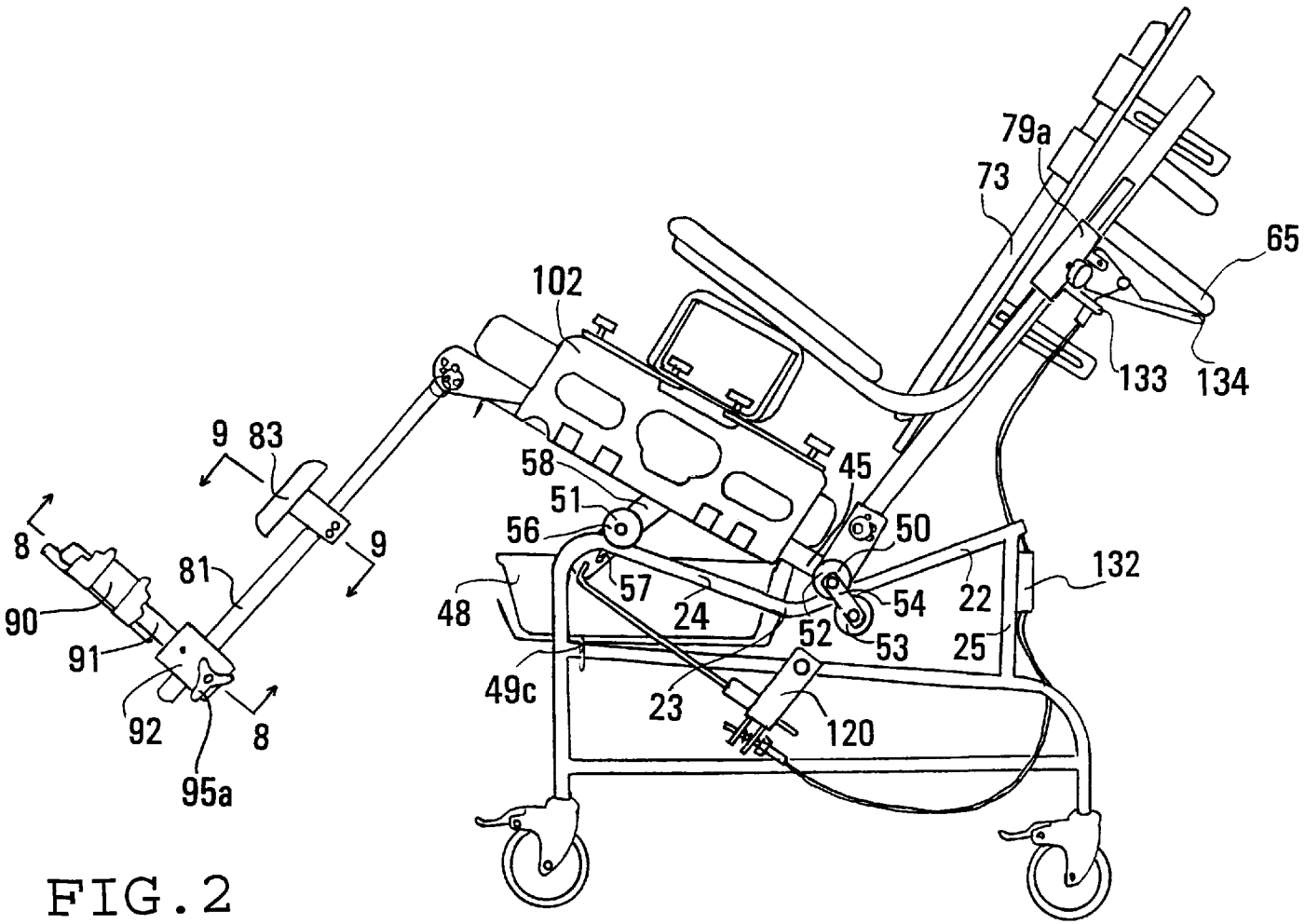
FIG. 2 is a schematic side plan view of the chair of FIG. 1, showing the tiltable assembly in a tilted position with respect to the showing in FIG. 1.
Figure 3:
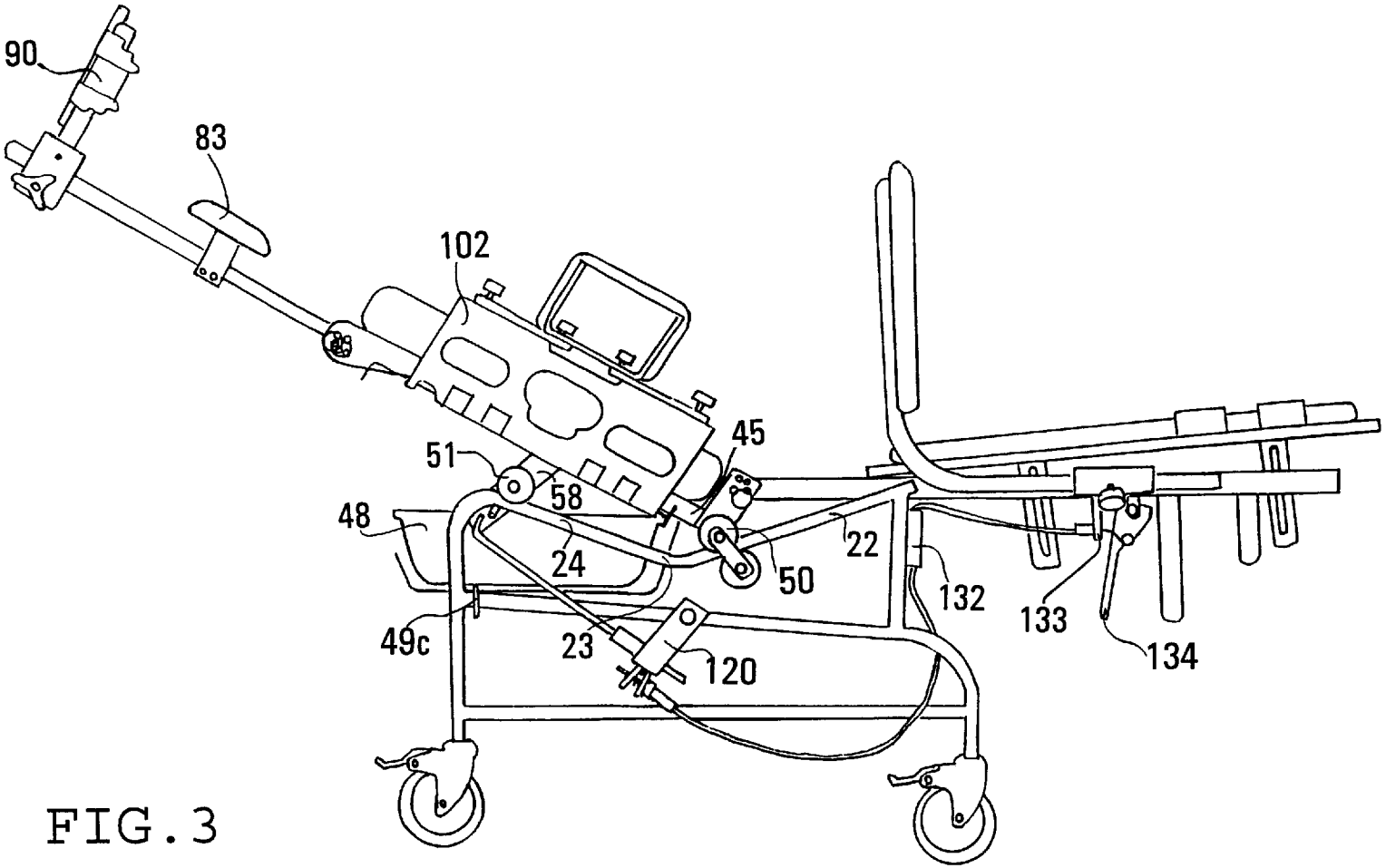
FIG. 3 is another schematic side plan view of the chair of FIG. 1 showing the tiltable assembly in a tilted position and additionally showing the back assembly in a pivoted substantially horizontal orientation and the leg assemblies pivoted to a projecting relationship substantially aligned with the seat assembly of the chair.

Referring to the drawing, and particularly FIGS. 1 through 3 inclusive, new chairs of this invention have a base assembly suitably called an undercarriage 10 and a tilt-able assembly 30 mounted on the base assembly in a manner permitting the tilt of it with respect to the base assembly. The tilt assembly has a basic seat assembly 40 and in other respects may have other elements, which almost always will include a back assembly 60 and leg assembly 80 and frequently will also include a hip-limiting assembly 100. A brake system 120 for holding the tiltable assembly against movement on the undercarriage and shiftable between a locked braking condition and an unlocked non-braking condition is also important for the chair. As this description proceeds, the extraordinary simplicity of the structural elements and their relationships will become more and more evident.

The undercarriage is believed to be properly characterized as the epitome of utilitarian design. It has left 11 and right 12 lateral sides equipped with a track system. The frame of the undercarriage may have only two cross braces or bars 13, 14, uniting the left and right lateral sides of the undercarriage. The two cross braces are placed one above the other and are somewhat V-shaped with the vertex of the V facing forward. The lack of rear cross bracing is important for the option of moving the chair over a toilet bowl when a commode seat member is employed.

The right lateral side of the undercarriage is a mirror image of the left, and thus only the left lateral side will be discussed in detail. The left side has a depending front support leg 15 and a depending rear support leg 16 and lateral bracing extending therebetween. Ideally, one lateral brace element 17 above the other 18 is sufficient for the side bracing. At the uppermost edge or uppermost extremity of the lateral side is located a track system 20. It preferably takes the form of a rail defining the uppermost edge of the lateral side. The rail and the other frame parts of the undercarriage may all be formed using the same type of tubular material having a circular cross-section. The rail has a rear track 22 that descends from the rear of the lateral side to a mid-part 23 of the lateral side (see FIGS. 2 and 3 for best recognition) and then a forward track 24 that ascends from the mid-part 23 of the lateral side to the front of the lateral side. The angle of descent from the horizontal may vary between extremes such as about 15 degrees at the low end and about 35 degrees at the high end, preferably within the range of about 20 degrees to about 30 degrees (and ideally at about 26 degrees from horizontal). The angle of ascent with respect to the horizontal can vary similarly but may be a few degrees less than the selected angle of descent. It is within these angular ranges that the major benefits of gravity-assisted tilting and return adjustment to a non-tilted condition are gained. Also, by employing the most ideal angulation for the descent and ascent (i.e., about 26-degree descent from horizontal and a bend of the descent track of about 46 degrees to form the ascent portion), one gains a substantially 30-degree tilt of the seat of the chair, as is preferred for effective body weight shift.

As illustrated, the track descending and the track ascending are united into a single stretch of rail that forms a broad V at the mid-part of the lateral side. The front of the lateral side where the front leg 15 is located may be connected via a curvature to the tubular element that forms the rail 24. At the rear of the track that descends from the rear of the lateral side, it is appropriate to brace the very rear end of the track rail (and terminate the very rear end of the track rail) at a location slightly recessed forward from the rear depending support leg of the side. A rear brace leg 25 is illustrated. This inward brace prevents excessive rearward movement of the seat and provides some assurance against backward tip-over of the chair. In other words, having a rear support leg at a location a little further toward the rear than other elements of the lateral side of the undercarriage contributes to a more stable chair.

An important point to notice is that the lateral side frame 11, even including the track system portion of it, may be and preferably is made up of the simplest of round tubular rods. A critical descending section of rail 22 and a critical ascending section of rail 24 are required, but the sections may be fabricated as separate elements. Of course, by far the most preferred and economical and reliable approach is to form the descending and ascending parts from a single length of rail as illustrated.

Each depending support leg (front 15 and rear 16) of the undercarriage is supported on a roller caster 26 for rolling the chair to locations as desired, and each caster is suitably equipped with a foot-operated brake 27 (having a cam bump for shifting in and out of braking contact with a castor wheel) for locking the caster against rotation (e.g., locking the wheel of the caster against rotation). The wheel brakes are easily unlocked (by a pivot action) to permit rotation of the wheel of the caster. The simplicity of the undercarriage is especially important when the chair is used in shower bathing. The closed tubes of the tubular frame readily dry after a shower and are not damaged by water.

A tiltable assembly 30 is supported on the track system of the undercarriage. This assembly also has features of extraordinary simplicity, despite its several parts and its several features of adjustability.

Figure 6:
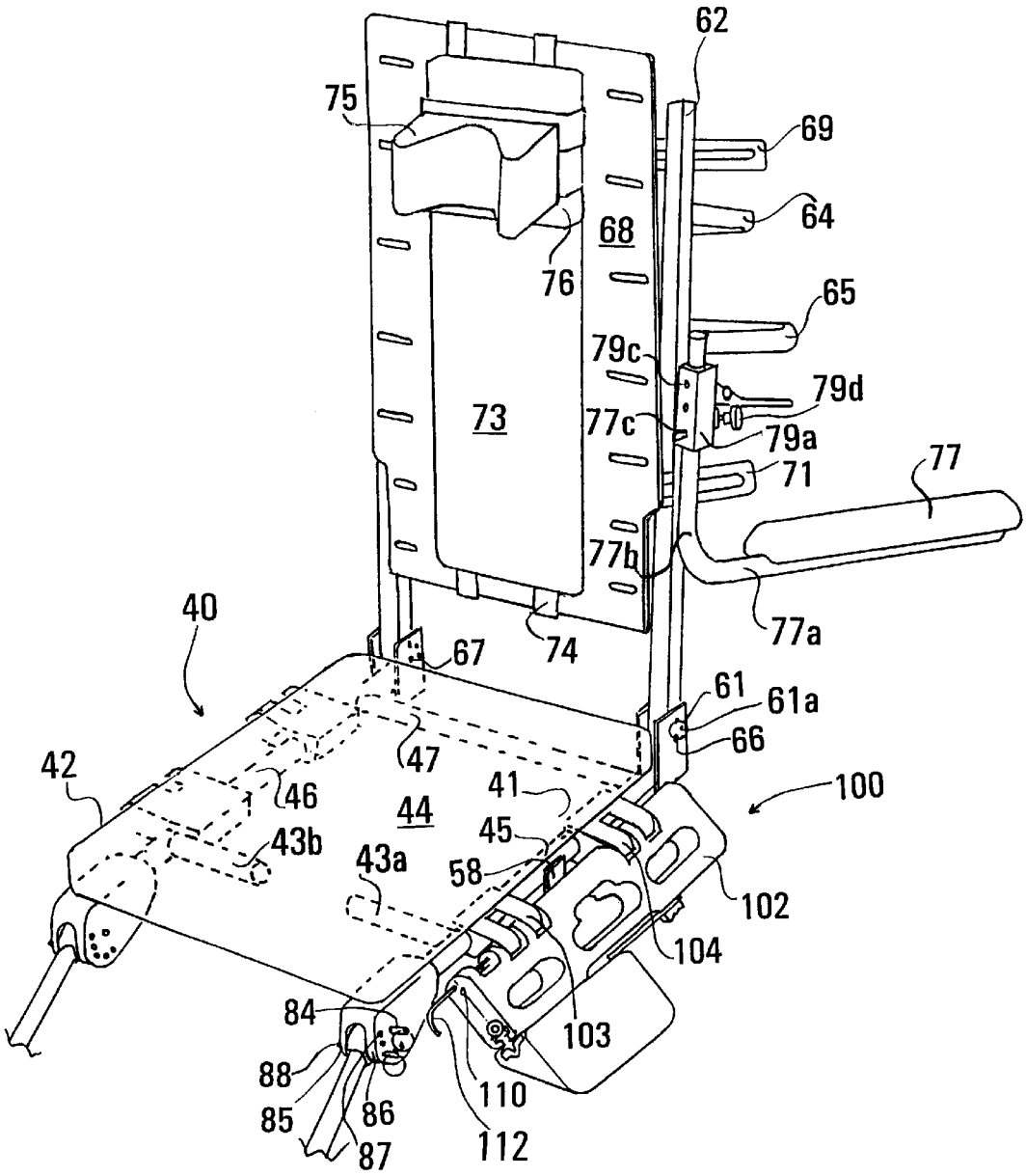
FIG. 6 is a schematic perspective view showing a seat member (e.g., one not equipped with an opening for commode use) and showing a hip-limiting assembly pivoted downward to an inoperable position below the upper surface of the seat member, plus other assemblies with parts broken away or omitted and especially illustrating elements of the back assembly including an arm rest assembly pivoted to an out-of-the-way position, and also illustrating the mounting of leg assemblies to the forward or front lateral sides of the seat assembly.

A basic critical part of the tiltable assembly is the seat assembly 40 (FIG. 6 is the best showing of it). It has lateral sides 41, 42. The illustrated seat assembly includes a padded seat member 44 (shown in FIG. 6), with or without an opening or recess for commode use, supported by a seat frame. The seat frame has lateral elongated frame elements or rods 45, 46 extending along its sides between the front and rear of the seat assembly and a single cross brace or rod 47 extending from the left lateral frame element 45 to the right lateral frame element 46 and bracing the two together at a location proximate to the rear of the seat assembly. At a location proximate to the front of the seat assembly are cantilevered frame elements or rods 43*a*, 43*b* that extend perpendicularly inward from the lateral rod-like frame elements 45, 46. The cantilevered rods extend inward but leave a gap between their inner ends so as to facilitate use of a padded seat having an opening extending from the very front of it to an inward area toward the rear of it for purposes of commode use. All of the seat-supporting rod-like frame elements are preferably tubular.

Mounted to the seat assembly, and particularly to the lateral rod-like frame elements on each side of it, are track followers. Since the left and right lateral sides are mirror images, only the left will be described in detail. A rear track follower 50 is mounted to the seat assembly (e.g., seat frame 45, see FIG. 1 and particularly FIG. 2) at a location proximate to the rear of the lateral side of the seat assembly, and the forward track follower 51 is mounted (as on a depending mounting arm 58) in a depending relationship to a mid-part along the lateral side (e.g., at the frame) of the seat assembly (see FIGS. 1, 2, and 6). Each track follower has a preferred form, namely a roller and holder. The roller rides on the rail track of the undercarriage and the holder extends under the rail track so as to prevent derailment of the roller from the track. Preferably, each roller riding on the track is in the nature of a pulley (i.e., the roller has an annular groove about its exterior, and this groove mates with round tubular rails).

The rear holder for preventing derailment likewise preferably is a grooved roller or pulley, for the reason that return of the tiltable assembly from a tilted condition to a condition with the seat assembly at a level orientation involves a modestly slight lifting motion for the rear of the tiltable assembly by a care-giver. The slight lifting motion (exerted at the handle cross brace on the rear of the back assembly) has its effect at the rear of the lateral sides of the seat assembly. Thus, a holder in the nature of a pulley for the rear track follower is most ideal since it will readily roll on the underpart of the round tubular sides. Illustratively (see FIG. 2), the rear holder pulley 53 is mounted for rotation on an axis shaft suspended by pivot arms 54 from the axis shaft of the rear track follower pulley 52.

The forward holder for preventing derailment of the forward roller pulley of the forward track follower may be much more simple than a rotatable pulley as preferred for the rear holder. As illustrated, the forward holder 57 (see FIG. 2) for preventing derailment of the pulley 56 of the forward track follower 51 may simply be a projecting bar or rod-like element 57 mounted on the mounting arm 58 depending from a mid-location of the seat assembly. The holder projecting bar 57 for the forward track follower extends under the rail to obstruct derailment of the forward pulley of the forward track follower system.

As illustrated, the shaft for rotation of the rail-riding pulley 52 of the rear track follower 50 suitably is mounted (i.e., anchored) at the rear part of the lateral tubular seat frame 45, and the shaft for rotation of the rail-riding pulley of the forward track follower is mounted (i.e., anchored) in the depending arm 58 extending downward from a mid-location on the lateral frame 45 of the seat assembly. The location of the shafts for pulley track-follower rotation is such that the pulleys for each track follower rest on the rail track at respective locations along it for placing the seat member in a horizontal or level orientation when the track followers are at the rearmost portion of the respective slopes they traverse for tilting action.

Figure 4:
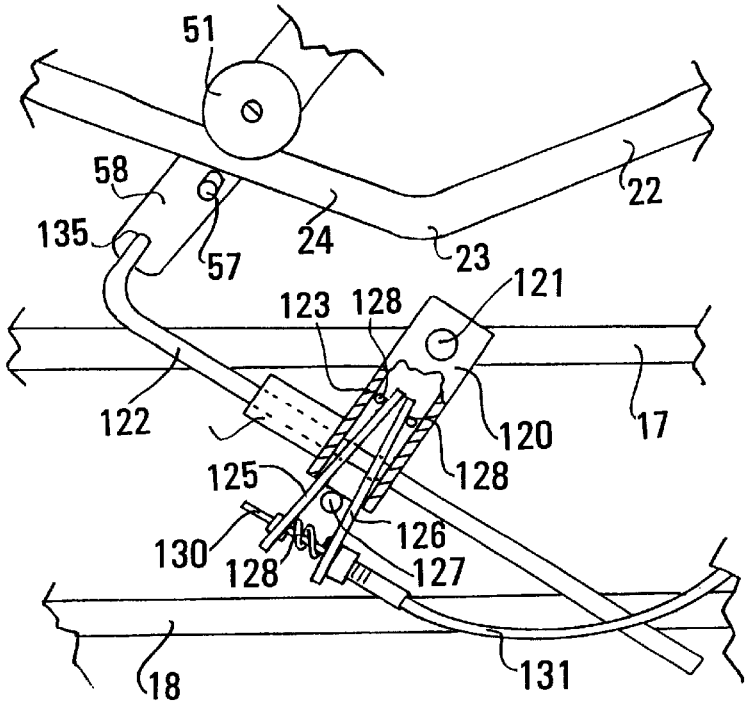
FIG. 4 is a schematic side view of a brake and elements of its immediate environment, with parts of the brake housing broken away to show the brake elements in locked condition.

Highly effective braking is provided for the tilt system of the chair. While brakes other than as illustrated may be employed, the illustrated form of braking has several advantages not the least of which is its simplicity and effectiveness. The brake system on each side is identical, and therefore detailed description will be limited to one side. As illustrated (see FIG. 4), the brake 120 is mounted on the undercarriage 10 at any suitable lateral brace element 17 of the lateral frame of the undercarriage. The brake housing 123 preferably is mounted for modest pivot action on a shaft 121 projecting from a frame element 17 of the undercarriage. The brake 120 operates on a brake rod 122 pivotally mounted on the tiltable assembly 30, as at a pivot 135 at the lower extremity of the depending arm 58 or bar carrying the forward or front track follower 51 (sometimes called the mid-part track follower 51). The brake rod 122 is guided through the brake 120 by housing elements 124 of the brake such as a port or hole (including any sleeve option) on opposite sides of the housing 123 for the brake.

The operable elements for braking (i.e., locking the brake rod 122 against movement) are plate members 125, 126 shiftable between a parallel relationship (or substantially so as in FIG. 5) and an angular relationship (as in FIG. 4) by pivot action upon an axis illustrated in the drawing to be a cross bar 127 adjacent an external edge of an opening into the brake housing 123. The brake plate members extend as internal parts or legs into the housing. Internally of the brake housing, any suitable pinching force 128 (e.g., knobs or springs pressing against the outer side of each internal plate leg extending into the housing) is employed to bias or otherwise maintain the internal legs toward each other. The brake rod 122 passes through a hole in each plate leg 125, 126 at a location internally of the housing 123; and the hole through each internal plate leg is just sufficiently large to provide good clearance for the movement of the brake rod 122 therethrough when the brake plates are in parallel (or substantially parallel) orientation. But the hole is small enough to cause the plates 125, 126 to grip against the brake rod 122 (and hold it against shifting movement through the holes of the plates) when the brake plates 125, 126 are in a biased angular condition with respect to each other. The external plate legs are biased away from each other, as by a spring 128, but can be compressed toward each other to shift the angular relationship of the plates to a parallel relationship. To compress the external plate legs into a substantially parallel relationship (i.e., a substantially parallel relationship for the entire length of the plates), a cable 130 and a tubular sheath 131 within which the cable operates (i.e., shifts) are attached to the external legs of the brake plates. Specifically, the cable sheath 131 is attached to the exterior near plate leg 126. The cable 130, after passing through a hole in the near plate leg 126 to the remote plate leg 125, is attached to the remote plate leg 125.

Figure 5:
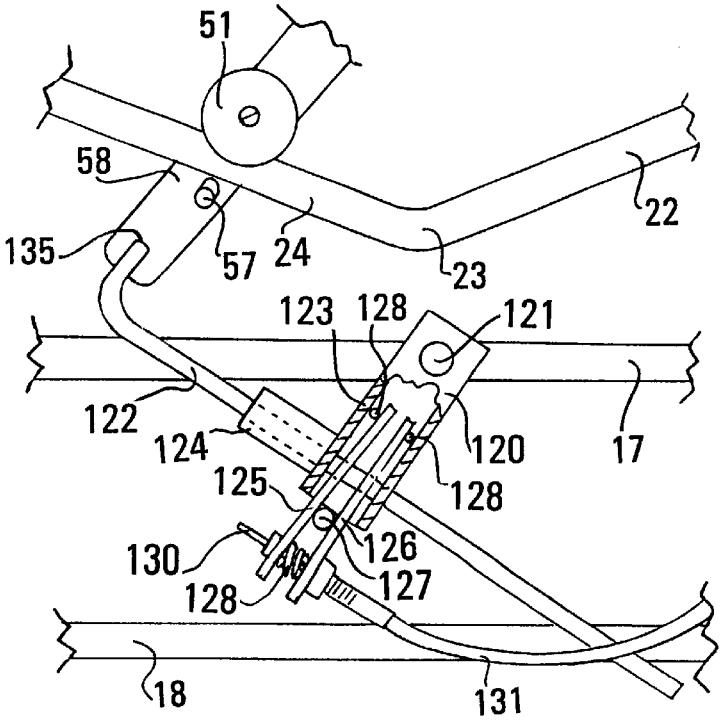
FIG. 5 is a schematic side view comparable to that in FIG. 4, but showing the brake elements in unlocked condition permitting slide action of the brake rod through the brake.

The cable 130 and cable sheath 131 extend from the brake 120 through any suitable guide members such as 132 on the undercarriage 10 (see FIGS. 2 and 3) up to an anchor element 133 on the tiltable assembly (see FIGS. 2 and 3) as at the frame for the back assembly 60. The cable sheath 131 is attached to the anchor element 133, and the cable 130 then extends beyond the anchor element to a pivotable lever 134. When the lever 134 is raised, it pulls on the cable 130, which pulls the most remote or far external part of the brake plate 125 toward the near brake plate 126 at its external leg or part to which the cable sheath 131 is attached. The reactive force of such cable pulling is received on the cable sheath 131 and effectively moves the external leg or part of the near brake plate 126 toward the external leg or part of the far brake 125, thus causing the brake plates 125 and 126 to pivot on the cross bar 127 of the brake housing and thus causing the entire length of the brake plates 125, 126 to move into a substantially parallel orientation (such as shown in FIG. 5) that permits easy sliding of the brake rod 122 through the hole of the interior legs of the plates 125, 126.

To be observed is that the permissible pivot of the brake housing at the shaft 121 of its mounting on a brace 17 of the undercarriage saves against unwanted binding or obstruction of movement for brake rod 122 during chair tilting action (which tilting is accomplished when the brake plates are pulled to a substantially parallel relationship). Tilt action pivot of the brake housing at its mounting 121 on the undercarriage is caused by the fact that the brake rod 122 changes position during tilting of the tiltable assembly. It too is pivotably mounted at its attachment 135 to the depending arm 58 on which the forward track follower 51 is mounted.

An operator handle 140 suitably connects each of the brake levers (marked 134*a* and 134*b* in FIG. 1) mounted on the frame posts of the back frame 60 so as to permit a single hand squeeze movement for lifting each lateral side brake lever and thereby effecting simultaneous unlocking of each lateral side brake. Release of the handle 140 returns the plates of the brakes to an angular orientation locking the brake rods and therefore the entire tiltable assembly against movement on the undercarriage.

Noteworthy is the fact that brake operation involves a shifting of elements between a locked and an unlocked condition, which is exceedingly preferable over any brake system requiring multiple rotational movements on separate brakes for each side of the chair. Further, considerable convenience is provided by having the operator handle 140 for brake operation located on the tiltable assembly where it is easily reached without stooping to the level of the undercarriage.

Figure 7:
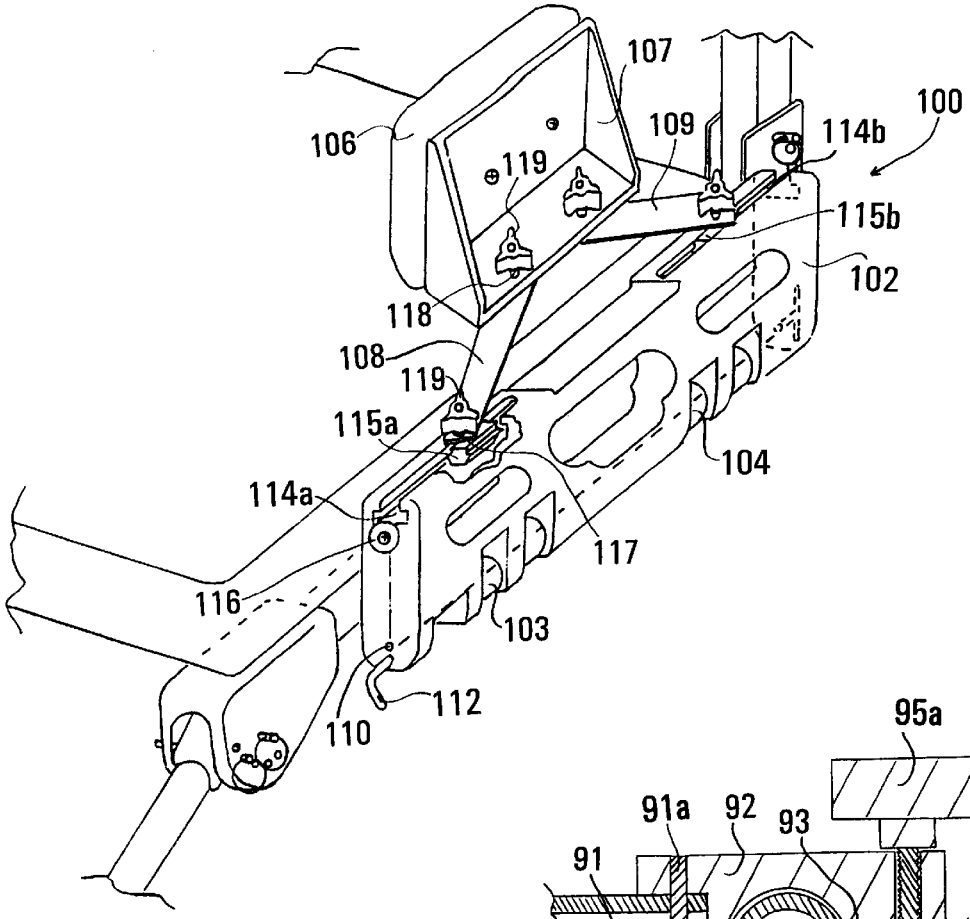
FIG. 7 is a schematic perspective view of the hip-limiting assembly and particularly illustrates details for the adjustment of the hip pad portion of it to varied positions from the lateral edge of the seat assembly (which is shown with parts broken away)

The new adjustable hip-limiting assemblies 100 give a new dimension to chairs for the handicapped. A hip-limiting assembly is on each lateral side of the seat assembly, but because they are mirror images of each other, only the left will be discussed, and discussion will center on FIGS. 6 and 7. The left assembly 100 is mounted on the left lateral side 41 of the seat assembly. In particular, the foundation member 102 of the hip-limiting assembly is mounted through a hinge (such as mounting hinge components 103 and 104 fixed on the seat frame rod 45) to the left lateral frame rod member 45 of the seat assembly. That rod 45 of the seat assembly extends from the rear to the front along the lateral side of the seat assembly. The major elements of the hip-limiting assembly are the foundation member 102, a hip pad 106 with frame 107, and an adjustable link (such as arms 108 and 109) between the foundation member 102 and the hip pad 106 for varying the distance of the hip pad from the foundation block or member. The foundation member or block 102 is preferably hingedly mounted at the lateral side of the seat assembly so as to permit pivoting of it and the entire hip-limiting assembly into an out-of-way condition that permits movement of a handicapped person in a lateral direction off the seat member 44. The foundation block 102 for the hip-limiting assembly also serves the desirable function of elevating the features 108 and 109 for adjusting the pad 106 of the assembly in relation to the level of the seat of the chair. The foundation block or member 102 is one "leaf" of a hinge and the other "leaf" is formed of mounting parts 103 and 104 fixedly united to the left frame rod 45 of the chair seat. The hinge action for the foundation block is at the axis pin 110 extending through the interlinked pin-receiving hinge "leaves." A locking pin 112 axially displaced extends in parallel to the axis of the axis pin 110 of the hinge. The locking pin can be shifted lengthwise (i.e., in the direction of its length); it is inserted through aligned bores extending through body parts of the interlinked hinge elements to hold the foundation block against pivot movement. When the locking pin 112 is slid out of that locking relationship, pivot action for the hip-limiting assembly (i.e., mounting block 102, pad 106, and adjustment link 108, 109) is allowed so as to move it to an out-of-the-way position such as illustrated in FIG. 6.

Adjustment of the hip pad 106 with respect to the foundation block 102 at the lateral side of the seat is accomplished through a linkage. At the upper part of the foundation block is a guideway 114, suitably in the nature of a channel. As illustrated (see FIG. 7), a front guideway 114*a* as well as a rear guideway 114*b* in aligned relationship are at the upper portion of the foundation block. Each guideway has a slot opening extending in a direction parallel to a side of the chair seat member 44 and smaller in width than the interior concavity of the guideway. Within each guideway is a guideway follower or slide nut 115*a*, 115*b* contoured in a manner such that it will not rotate in but will slide along the guideway. Each is prevented from accidental exit at an end of a guideway by a stop such as at 116. The stop has a part blocking the end of the channel. The guideway followers or slide nuts have a threaded shaft 117 that projects perpendicularly upwardly out of the guideway slot and on which an end of a linking arm 108 is mounted to permit pivoting of the arm on the shaft 117. A similar pivot mounting for an end of the other linking arm 109 to slide nut 115*b* is provided. The other end of the arm 108 is fixedly mounted on an upwardly projecting threaded shaft 118. Shaft 118 projects upward through a hole in frame 107 of the hip pad structure. (The end of arm 109 has a similar fixed threaded shaft that extends through another hole in the hip pad frame 107, and the holes in the hip pad frame are laterally spaced from each other.) To prevent pivot movement of each end of the linking arms 108, 109, a tightening mechanism is provided at each end. A threaded triple-winged nut 119 for easy hand tightening is an excellent tightening mechanism. Tightening the nuts 119 prevents or obstructs longitudinal shift of the guideway followers 115 in the guideways 114 and prevents or obstructs pivot movement of the hip pad 106 at its arm connections. (Optionally, the tightening may be accomplished by reversing the position of nuts and threaded shafts for the tightening features at the ends of the arms 108 and 109; any suitable tightening arrangement to fix the ends against movement may be employed.)

In use, the hip-limiting pads at each lateral side are adjusted inward from their foundation blocks to a point that the pad portions of each side assembly limits lateral shift of the hips of a handicapped person. In a sense, the pads serve as a support for the hips, although direct contact with the hips may not always be necessary. At the least, they function as limiting elements to prevent undue lateral shift of the hips of the person occupying the chair.

The ideal back assembly 60 for the chair (see FIGS. 1 and 6 in particular) may have several components. It has a back frame 62, 63, 64, 65 hinged at axis shafts 66, 67 for pivotable movement with respect to a seat member 44. A back support plate or member 68 is adjustably mounted on the back frame. Then, a padded back member 73 is removably and adjustably mounted (as by contact fastener elements 74) on the back support member 68. Optionally, a padded head-holding assembly 75 may be adjustably and removably mounted (as by contact fasteners 76) on the back padded member (or by contact fastening to the back support member). The back assembly also preferably includes arm rests 77, 78 adjustably mounted (as at anchoring sleeves 79*a* and 79*b*) to the back frame of the back assembly.

The back frame suitably has a post element 62, 63 at each lateral side and one or more (illustrated are two) cross brace connectors 64, 65 extending between the post elements. The cross brace connector frame elements preferably project backward from the posts and then across the back to form bar-like handles. They combine the function of bracing with the function of providing a handle or handles for moving the chair.

The bottom of the left lateral post 62 of the back frame is hinged at axis shaft 66 at the rear of the seat assembly at the rear of the left lateral frame element (e.g., tubular rod) of the seat assembly. The right lateral post 63 of the back is similarly hinged to the seat assembly at the right lateral side of the seat frame. A suitable hinge to employ is one having parallel plates spaced apart and fixedly mounted on opposing sides at the rear of each lateral tubular frame rod of the seat frame. This is illustrated in FIG. 6. A back frame post 62 is inserted between the plates, and an axis shaft 66 passes through the plates and post for pivot action about that shaft. Fixing the back assembly against pivot action with respect to the seat assembly may be accomplished in any of a variety of ways. Illustratively, step-wise pivot holding of the back assembly to different angular positions with respect to the seat assembly is accomplished by placing a removable pin 61 (see FIG. 6) in any selected aligned holes 61*a* in a series of circumferentially spaced holes for receiving the pin, as illustrated in the drawing. Step-wise pivot to any particular hole location is suitably accomplished by pivoting the back frame until its pin hole is aligned with a set of the pin holes 61*a* in the plates of the hinge and then inserting the pin 61 in that location. Comparable pivot orientation is employed for each lateral hinge of the back frame.

To be particularly observed is that the lower cross brace 65 between the back posts of the back frame is functionally positioned not only as a handle member for moving the chair on its wheels but also as a handle member for pinching t he connector operator handle 140 for the control levers 134*a* and 134*b* of the brake against brace 65 (as illustrated for example in FIG. 2), to thereby unlock the brake for tilting of the entire tiltable assembly with respect to the undercarriage.

The back support member 68 of the back assembly is for support at the back of an individual and may be made of any suitable sheet or plate material, with or without the illustrated slot openings along the sides. The slot side openings may be used to anchor straps to hold an individual, if desired. Strong hard plastic plates (e.g., those of cast urethanes) are excellent to employ to form the back support plate 68. Slotted brace supports 69, 70, 71, 72 extend rearwardly from the back support member for fixing it at different distances and angular relationships with respect to the lateral posts 62, 63 of the back frame. Illustratively, a rearwardly extending slotted brace support 69, 70 is proximate to the upper part of each lateral side of the back support; and another such back support 71, 72 is at a mid-back or slightly lower location on each lateral side of the back support member. The slotted braces 69, 70, 71, 72 extend rearwardly from the back support member and are mounted for sliding movement (along their slot) on threaded shafts that extend inwardly from the lateral posts of the back support member. winged nuts (as at 70*a* in FIG. 1) are used on the threaded shafts to tighten the slotted braces against the back frame posts as at post 63 in FIG. 1) and hold the back support 68 at a fixed location relative to the back frame posts 62, 63. The arrangement permits a variety of slopes as well as spacing distances for the back support 68 with respect to the back frame.

On the back support plate or member 68 a pattern of contact fastening elements 74 may be fixedly mounted as by any suitable strong adhesive, preferably of the water-insoluble type. Illustrative contact fastener elements are hook elements for one part and loop elements for the other, and such hook and loop fasteners have been popularized under the trademark VELCRO. Importantly, however, any variety of fastening elements may be employed; preferably those that can withstand repeated water exposure without damage are used. A pattern of contact fastener elements is applied as at 74 on the front or face portion of the back support member 68 as well as at the rear of a pad 73 to be fixed to the back support member. Further, a pattern of contact fastening elements 76 may be applied at the upper end of a back pad 73 and at the rear of a padded head-holding structure 75 for the purpose of contact fastening the padded head-holding structure on the back assembly. Contact fasteners permit a variety of possible adjustments for padding and the easy removal of it when desired.

While arm rests 77, 78 may be mounted to sides of the seat of a chair, they preferably are not. Mounting of them to the back frame exclusively (i.e., as the only mounting point for them) gives added convenience to a care-giver handling the chair for a handicapped person. on each lateral side of each post of the back frame is fixed an anchoring sleeve (suitably a square tubular or round tubular element). Only one is illustrated at number 79*a* in FIG. 6 and the other is a mirror image. Thus, the arm rest 77 at the left will be described in detail and is exemplary of the other. The arm rest 77 (preferably padded) can be on a tubular frame 77*a* that is curved to form an upright mounting extension or arm 77*b* that extends through the tubular anchoring sleeve 79*a* on the post of the back frame. The simplest arrangement for varying the height of the arm rest is to provide an aligned series of holes 79*c* spaced along the length of the anchoring sleeve structure. The series is in parallel relationship to the posts of the back frame. A detent 77*c* (such as a spring knob 77*c*) is mounted in the mounting arm 77*b* of the arm rest for easy shifting of the height of the arm rest to different elevations so that the detent 77*c* will temporarily lock into a hole of the aligned series 79*c* and hold the arm rest at that level until the detent is pressed to change the level or remove the arm rest from the anchor sleeve 79*a*.

(Of course, a removable pin and aligned holes as for adjusting the tilt of the back assembly could alternatively be used; and still further, if desired, mechanisms for linear incremental adjustment could be used wherever step-wise adjustment is taught herein. Such sophistication, however, detracts from the preferred simplicity illustrated.)

To further rigidify the arm rest against shifting motion once it is at a selected height, the possibility of rotating a knob 79*d* to press a shaft (threaded in the anchoring sleeve wall) against the mounting arm 77*b* of the arm rest may be employed.

Leg assemblies for the chair may sometimes be critically necessary and at other times may not be wanted. Conveniently adjustable and removable leg assemblies are provided, one for each side of the chair. Each is a mirror image of the other. The leg assembly 80 at the left of the chair will be described (see FIGS. 1, 2, and 6 in particular). It has a leg rod 81 (preferably straight but optionally contoured) mounted at a front lateral side of the seat assembly. A footrest 82 pivotable into position for placing a person's foot on it or pivotable to a position not capable of supporting or resting a foot is provided. A calf support 83 is also provided.

The rod 81 of the leg assembly is mounted at a front lateral side of the seat assembly on the frame of the seat assembly and is particularly mounted to be pivotable at a removable hinge axis pin 84 extending between lateral plates 85, 86 fixed on the front of the lateral frame rod 45 of the seat assembly (see FIG. 6). The removable axis pin extends through aligned holes in the plates 85, 86 and through a hole at the upper end of the leg rod 81 and permits pivoting of the leg rod forwardly and upwardly to various angles, and also permits removal of the entire leg assembly from the chair (simply by pulling out and thus removing pin 84). Radially spaced from the axis pin 84 is an arcuate or circumferentially oriented series of adjustment pin holes 87. A removable adjustment pin 88 is inserted through an aligned set of adjustment pin holes in plates 85 and 86 and through an aligned holding pin hole at the upper end of the leg rod (i.e., a hole in the leg rod at a radially spaced location from the axis pivot pin 84 in the leg rod) to fix the leg rod at a selected angle of orientation with respect to the seat assembly. A step-wise change for the angle of the leg rod from the seat assembly is possible by pivot shift of the leg rod about the axis pin 84 and then fixing the leg rod at the selected angle by inserting the holding pin through the pertinent aligned holes of the adjustment series. FIGS. 2 and 3 illustrate the possible extent for the angular variation of the leg rod 81 to the seat assembly 40.

The illustrated leg rod is tubular and is provided with an underlying lengthwise or linear guideway or guide structure for adjustment of the height or distance of a footrest 82 from the axis mounting end of the leg rod as well as for adjustment of the height or distance of a calf support 83 from the front of the axis mounting end. A similar guideway may comprise a linear rib or slot or some other linear structure defining a linear path. For convenience, the linear guideway for the footrest will be illustrated as a linear rib and the linear guideway for the calf support as a linear slot.

Figure 8:
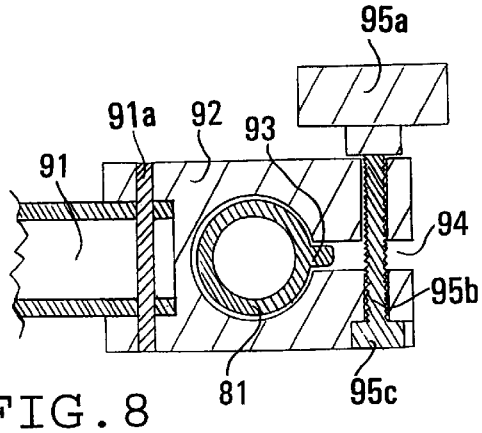
FIG. 8 is a cross-section at line 8—8 of FIG. 2 illustrating the manner of mounting the foot rest on the base leg rod of the leg assembly.

The footrest 82 (see FIGS. 1 and 2) may be pivotally mounted as at 90 for shifting between an upright folded condition and a lowered footrest condition (or it may be rigidly fixed to prevent pivot shift). It is mounted on a foot shaft 91, which in turn is fixedly mounted as by pin 91*a* to a block-like sleeve clamp 92 about leg rod 81. As shown in FIG. 8, the foot shaft 91*a* is united to sleeve clamp 92 within which leg rod 81 extends. A rib 93 projects linearly along the length of the leg rod 81 at its lower portion, and particularly projects into the jaw opening 94 of the clamp 93. The jaw opening 94 has adequate space to accommodate projection of the rib 94 into it, but no great clearance for the projection is necessary. In fact, when the sleeve clamp is tightened, the jaws of the clamp press against the rib and prevent rotation of the clamp along the leg rod 81. Tightening of the clamp is accomplished when the triple winged nut 95*a* is threaded on the threaded shaft 95*b* of the embedded bolt head 95*c*. In short, turning the nut 95*a* tightens it upon shaft 95*b* and squeezes the jaws of the clamp 92 against the tubular leg rod 81 to fix the clamp 92 at any selected location along the length of leg rod 81. The tightening action binds the entire footrest assembly not only against rotary shift about the leg rod, but also against longitudinal shift along the leg rod. The features of the foot rest mounting permit easy positioning of a foot rest at any selected position along the ribbed leg rod.

Figure 9:
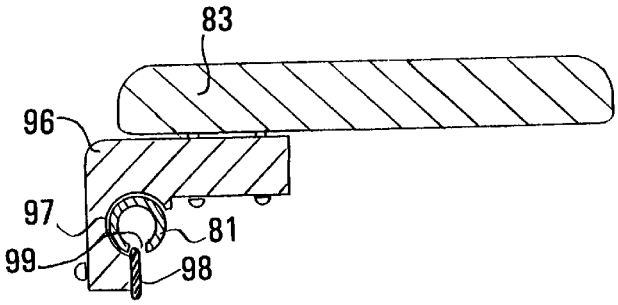
FIG. 9 is a cross-section at line 9—9 of FIG. 2, illustrating the manner of mounting the leg pad on the base leg rod of the leg assembly.

Adjustability for the calf support 83 may be quite different, although it could be the same as for the footrest. In the case of the calf support, a convenient mounting is best illustrated by a cross-section through the support and through a slotted portion of a tubular leg rod (see FIG. 9). The calf support 83 is mounted on the leg rod 81 by a curved motion around the leg rod. Specifically, the mounting base 96 for the calf support is in the nature of a block having a groove 97 curved in it. The groove has a C-shape and has the same internal diameter as the external diameter of the leg rod 81 (i.e., substantially the same and certainly not with any great clearance between the two). The curvature forming the C-shaped groove 97 in the mounting block has a circumference of at least about 190 degrees and not over about 230 degrees, preferably within the range of about 195 to about 220 degrees. The remainder of the circumference (except for hook 98) is open and forms an entry into the groove. The opening of the groove in the mounting block faces in a direction that extends under but is directed away from the calf pad. One edge of the groove is furthest from the outer surface of the calf pad 83 and is approximately at a 180 degree location from the outer substantially flat surface of the calf pad. This edge is provided with a key hook 98 in the nature of a thin plate. The hook extends lengthwise along that edge, thereby forming a hook edge for the opening into the groove 97. The hook along the edge is fitted into the slot 99 of the leg rod (as illustrated in FIG. 9), and then the entire assembly of the calf support 83 is rotated around the leg rod 81 so as to cause the leg rod 81 to slip into and rest within the groove 97 (and the hook to remain in the slot 99 of the leg rod). More or less a snapping action takes place when the leg rod is pulled into the groove by rotating the calf support. The mounting block 96 for the calf support preferably is formed of tough hard plastic having an extremely limited tendency to yield or flex. It should primarily be selected on the basis that it is relatively hard and resistant to all but a very limited flexing. A suitable structural plastic is high density polyethylene, but other plastics can be useful.

The tubular frame elements of the chair are most preferably formed of metal (e.g., stainless steel or aluminum or any other structural metal) and are suitably painted or coated with a protective and/or decorative skin. Electrostatically applied powdered plastic is a suitable way to form a protective coating and epoxy plastic gives excellent results. Spray painting or other techniques may alternatively be used to form a protective or decorative coating. Padded portions should have a continuous plastic layer tightly molded as a skin (as by dipping) about the internal padding, including underlying surfaces of a padded area. The plastic film or layer coatings should withstand repeated flexing without cracking and should serve as a barrier to water penetration into the underlying padding. Vinyl films formed by dipping are preferred, but other plastic coatings can be suitable to employ. Generally, the padding is formed by using compressible foam-type materials exhibiting an elastomeric character (i.e., materials exhibiting some recovery to a pre-compressed state after release of compression). Polyurethane foam is excellent, but any of a variety of compressible foam exhibiting some reasonable recovery from compression may be used. Elastomeric or rubber-like or plastic rims on the caster wheels are preferred. A protective shield is ideally mounted as a guard to protect or obstruct bumping of the brake assembly (i.e., to protect it from damage and to protect an individual against accidental injury from bumping it).

At the front extreme of movement of each forward track follower 51 of the seat assembly, a stop against continued movement is desirable, and interestingly, the brake rod 122 extending out from the depending arm or bar 58 that also carries the forward track follower can function (at its portion before it turns to pass through the brake housing) as a stop when it abuts against the curved front end frame of the track rail 24. The rear track follower is stopped in rearward movement when the pulley holder 53 of the rear track follower abuts against the slightly inwardly recessed post 25 of the frame at the rear of the track system.

A flexible belt material may be attached to each post 62, 63 of the back frame. A belt section on each post is drawn from the post and placed about an individual in the chair, and the ends of the sections are affixed together by any suitable elements (as by contact fasteners of the hook and loop character) to hold the individual in the chair.

Seat members without an opening through them (see FIG. 6), as well as those with an opening through them for commode use (see FIG. 1), are included within the ambit of the invention. Where seat members with a hole or opening through them for commode use are employed, the option to have the opening extend from the front edge of the seat into the back areas of the seat is preferred. When commode openings are employed, the option to include a removable collection pan 48 underneath the frame of the seat member is available (see FIGS. 1–3). Such a pan 48 may be supported in a skeleton or "basket" of wires or bands resting on elements under the seat 44. For example, bands 49*a* and 49*b* may depend from a resting relationship on the rear cross brace 47 of the seat frame and wires 49*c* may rest for sliding on any suitable side lateral brace 17 of the undercarriage so as to preserve the collection pan in a horizontal position even when the tiltable assembly, including the seat member of the chair, is tilted (see FIGS. 1–3). When tilting occurs, the collection pan skeleton support that rests on lateral tubular frame members 17 of the undercarriage slides upon the tubular members so that the pan retains a substantially horizontal orientation during tilt action.

The extraordinary simplicity of the chair structure commends adaptation of it for combined commode and shower bathing use. Its adjustability permits important features of comfort for handicapped individuals from child to adult. Care-giver convenience is enhanced by the simplicity and versatility and reliability of the special features making up the chair. Ease of chair tilting is assisted by gravity. The occupant's own body weight (i.e., center of mass) contributes to easy gravity tilting on the V-shaped track system. As tilting occurs, the occupant of the chair is moved forward in relation to the undercarriage—a movement that contributes to the stability of the chair.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A chair for handicapped individuals comprising an undercarriage having a track system including a rear track descending from the rear of said undercarriage to a mid-part thereof and a forward track ascending from said mid-part of said undercarriage to the front thereof, a tiltable seat assembly to which are mounted a rear track follower for following a said descending track of said undercarriage and a mid-part track follower for following a said ascending track of said undercarriage, a brake shiftable between a locked condition for holding said tiltable assembly against movement on said track system of said undercarriage and an unlocked condition for allowing manual gravity-assisted movement of said tiltable assembly on said track system of said undercarriage, a back assembly mounted on said seat assembly in a manner allowing for said back assembly to be tilted with said seat assembly and also shifted into a variety of angular relationships with respect to said seat assembly, and a handle on said back assembly at a location for convenient hand access by a person behind said chair for shifting said brake between said locked and unlocked conditions.

2. The chair of claim 1 wherein said rear descending track comprises a rail and said forward ascending track comprises a rail.

3. The chair of claim 2 wherein said rails of said descending and ascending tracks are united to form a V-shape.

4. The chair of claim 2 wherein said track followers comprise pulleys that ride upon said rails.

5. The chair of claim 4 wherein said track followers include holders that extend beneath said rails to prevent derailment of said pulleys.

6. The chair of claim 1 additionally having a flexible cable as the operable connection between said brake and said handle for shifting said brake.

7. The chair of claim 1 wherein said brake comprises an assembly mounted on said undercarriage and having facing plate members shiftable between parallel orientation and angular orientation, said plates having a hole in each through which a brake rod mounted on the tiltable assembly extends and is moved longitudinally through said plates when said tiltable assembly is moved on said track system.

8. The chair of claim 1 additionally having a hip-limiting assembly mounted on said seat assembly in a manner permitting movement of it out of the way to allow a patient to be shifted laterally off the seat assembly of said chair.

9. The chair of claim 1 wherein said back assembly includes a back frame and said back frame is the part of said back assembly pivotably mounted to said seat assembly, said back assembly additionally comprising a back support member adjustably mounted on said back frame for varying the location of said back support member with respect to said back frame.

10. The chair of claim 9 additionally including a padded member removably and adjustably mounted on said back support member.

11. The chair of claim 1 additionally including arm rests removably and adjustably mounted to said back assembly in a manner having no connection to said seat assembly and no connection to said undercarriage.

12. The chair of claim 11 wherein said mounting of said arm rests to said back assembly permits movement of said arm rests out of the way for a patient on said chair to be shifted laterally off the seat assembly of said chair.

13. The chair of claim 1 additionally including an adjustable hip-limiting assembly at each lateral side of said seat assembly, each said hip-limiting assembly comprising a foundation member hingedly mounted to said seat assembly, a hip pad on a hip pad frame, and an adjustable link between said foundation member and said hip pad frame for varying the distance of the hip pad from the foundation member, said hip-limiting assembly being pivotable at the mounting of said foundation member to the seat assembly so as to move said hip-limiting assembly out of the way for a patient on the chair to be shifted laterally off the seat of the chair.

14. The chair of claim 13 wherein said adjustable link between said foundation member end said hip pad frame includes an arm mounted at one end to said hip pad frame and at the other end to said foundation member in a manner adjustable to permit and to prevent sliding movement of said arm with respect to said foundation member.

15. The chair of claim 1 additionally including a leg assembly for mounting at each lateral side of said seat member, each said leg assembly comprising a leg rod, a removable and adjustable foot rest mounted on said leg rod, and a removable and adjustable calf pad mounted on said leg rod.

16. The chair of claim 15 wherein said calf pad includes a mounting block having a grooved recess and a hook along one edge of the recess, and wherein said leg rod includes a longitudinal slot into which said hook of said mounting block extends when said calf pad is mounted on said leg rod in a manner causing said leg rod to be lodged in said grooved recess of said mounting block.

17. The chair of claim 1 wherein said seat assembly comprises a seat member having an opening extending therethrough for commode use.

18. The chair of claim 1 additionally comprising an adjustable hip-limiting assembly at each lateral side of said seat assembly, each said lateral hip-limiting assembly comprising a foundation member mounted to said seat assembly, a hip pad on a hip pad frame, and an adjustable pair of linking arms between said foundation member and said hip pad frame for varying the distance of the hip pad from the foundation member in a manner that varies the distance between said hip pads of said lateral hip-limiting assemblies.

19. The chair of claim 18 wherein said foundation member of said hip-limiting assembly is pivotably mounted to said seat assembly so as to permit movement of said hip-limiting assembly out of the way for a patient on said chair to be shifted laterally off the seat assembly of said chair.

20. The chair of claim 18 additionally including arm rests removably and adjustably mounted to said back assembly in a manner having no connection to said seat assembly and no connection to said undercarriage.

21. The chair of claim 20 wherein said mounting of said arm rests to said back assembly permits movement of said arm rests out of the way for a patient on said chair to be shifted laterally off the seat assembly of said chair.

22. A chair for handicapped individuals comprising an undercarriage having a track system including a rear track rail descending from the rear of said undercarriage to a mid-part thereof and a forward track rail ascending from said mid-part of said undercarriage to the front thereof, a tiltable seat assembly to which are mounted a rear track follower for following a said descending track rail of said undercarriage and a mid-part track follower for following a said ascending track rail of said undercarriage, each said track follower comprising a pulley for riding upon a said track rail and a holder extending beneath the rail on which the track follower pulley rides to prevent derailment of the pulley, a back assembly mounted on said seat assembly in a manner allowing said back assembly to be tilted with said seat assembly, and arm rests removably and adjustable mounted to said back assembly in a manner permitting movement of said arm rests out of the way for a patient to be shifted laterally off the seat assembly of said chair.

23. The chair of claim 22 wherein said track rails are circular in cross-section an said pulleys have an annular groove mating with the circular cross-section of said rails.

24. The chair of claim 22 wherein said track rails are joined as one to form a V-shape.

25. A chair for handicapped individuals comprising a seat assembly and an adjustable hip-limiting assembly at each lateral side of said seat assembly, each said lateral hip-limiting assembly comprising a foundation member mounted to said seat assembly, a hip pad on a hip pad frame, and an adjustable pair of linking arms between said foundation member and said hip pad frame for varying the distance of the hip pad from the foundation member in a manner that varies the distance between said hip pads of said lateral hip-limiting assemblies.

26. The chair of claim 25 wherein said foundation member of said hip-limiting assembly is hingedly mounted to said seat assembly so as to permit movement of said hip-limiting assembly out of the way for a patient on said chair to be shifted laterally off the seat assembly of said chair.

27. The chair of claim 25 additionally including an undercarriage having a track system including a rear track descending from the rear of said undercarriage to a mid-part thereof and a forward track ascending from said mid-part of said undercarriage to the front thereof, and track followers mounted to said seat assembly for allowing tilting action of said seat assembly with respect to said undercarriage, said track followers of said seat assembly comprising a rear track follower for following a said descending track of said undercarriage and a mid-part track follower for following a said ascending track of said undercarriage.

28. The chair of claim 27 additionally comprising a brake shiftable between a locked condition for holding said tiltable assembly against movement with respect to said undercarriage and an unlocked condition for allowing manual gravity-assisted tilting movement of said tiltable assembly with respect to said undercarriage, and wherein a brake control lever on said tiltable assembly is used to shift said brake between said locked condition and said unlocked condition.

29. The chair of claim 25 additionally including a back assembly mounted on said seat assembly in a manner allowing for said back assembly to be shifted into a variety of angular relationships with respect to said seat assembly.

30. The chair of claim 29 wherein said back assembly includes a back frame and said back frame is the part of said back assembly pivotably mounted to said seat assembly, said back assembly additionally comprising a back support member adjustably mounted on said back frame for varying the location of said back support member with respect to said back frame, said back support member including a padded member removably and adjustably mounted on said back support member.

31. The chair of claim 29 additionally including arm rests removably and adjustably mounted solely to said back assembly and thus completely independent from said seat assembly and said hip-limiting assemblies.

32. The chair of claim 25 additionally including a leg assembly for mounting at each lateral side of said seat assembly, each said leg assembly comprising a leg rod, a removable and adjustable foot rest on said leg rod, and a removable and adjustable calf pad mounted on said leg rod.

33. The chair of claim 32 wherein said calf pad includes a mounting block having a grooved recess and a hook along one edge of the recess, and wherein said leg rod includes a longitudinal slot into which said hook of said mounting block extends when said calf pad is mounted on said leg rod in a manner causing said leg rod to be lodged in said grooved recess of said mounting block.

34. The chair of claim 25 wherein said seat assembly has a front and rear and wherein said pair of adjustable linking arms permit front to rear variation of the location of said hip pad.

35. A chair for handicapped individuals comprising an undercarriage having a track system including a rear track descending from the rear of said undercarriage to a mid-part thereof and a forward track ascending from said mid-part of said undercarriage to the front thereof, a tiltable seat assembly to which are mounted a rear track follower for following a said descending track of said undercarriage and a mid-part track follower for following a said ascending track of said undercarriage, and a brake shiftable between a locked condition for holding said tiltable assembly against movement on said track system of said undercarriage and an unlocked condition for allowing movement of said tiltable assembly on said track system of said undercarriage, wherein said brake comprises an assembly mounted on said undercarriage and having facing plate members shiftable between parallel orientation and angular orientation, said plates having a hole in each through which a brake rod mounted on the tiltable assembly extends and is moved longitudinally through said plates when said tiltable assembly is moved on said track system.

36. A chair for handicapped individuals comprising an undercarriage having a track system including a rear track descending from the rear of said undercarriage to a mid-part thereof and a forward track ascending from said mid-part of said undercarriage to the front thereof, a tiltable seat assembly to which are mounted a rear track follower for following a said descending track of said undercarriage and a mid-part track follower for following a said ascending track of said undercarriage, and a brake shiftable between a locked condition for holding said tiltable assembly against movement on said track system of said undercarriage and an unlocked condition for allowing movement of said tiltable assembly on said track system of said undercarriage, said chair additionally including an adjustable hip-limiting assembly at each lateral side of said seat assembly, each said hip-limiting assembly comprising a foundation member hingedly mounted to said seat assembly, a hip pad on a hip pad frame, and an adjustable link between said foundation member and said hip pad frame for varying the distance of the hip pad from the foundation member, said hip-limiting assembly being pivotable at the mounting of said foundation member to the seat assembly so as to move said hip-limiting assembly out of the way for a patient on the chair to be shifted laterally off the seat of the chair.

37. The chair of claim 36 wherein said adjustable link between said foundation member and said hip pad frame includes an arm mounted at one end to said hip pad frame and at the other end to said foundation member in a manner adjustable to permit and to prevent sliding movement of said arm with respect to said foundation member.

38. A chair for handicapped individuals comprising an undercarriage having a track system including a rear track descending from the rear of said undercarriage to a mid-part thereof and a forward track ascending from said mid-part of said undercarriage to the front thereof, a tiltable seat assembly to which are mounted a rear track follower for following a said descending track of said undercarriage and a mid-part track follower for following a said ascending track of said undercarriage, and a brake shiftable between a locked condition for holding said tiltable assembly against movement on said track system of said undercarriage and an unlocked condition for allowing movement of said tiltable assembly on said track system of said undercarriage, and a leg assembly for mounting at each lateral side of said seat member, each said leg assembly comprising a leg rod, a removable and adjustable foot rest mounted on said leg rod, and a removable and adjustable calf pad mounted on said leg rod, wherein said calf pad includes a mounting block having a grooved recess and a hook along one edge of the recess, and wherein said leg rod includes a longitudinal slot into which said hook of said mounting block extends when said calf pad is mounted on said leg rod in a manner causing said leg rod to be lodged in said grooved recess of said mounting block.

39. A chair for handicapped individuals comprising a seat assembly and an adjustable hip-limiting assembly at each lateral side of said seat assembly, each said hip-limiting assembly comprising a foundation member mounted to said seat assembly, a hip pad on a hip pad frame, and an adjustable link between said foundation member and said hip pad frame for varying the distance of the hip pad from the foundation member, wherein said foundation member of said hip-limiting assembly is hingedly mounted to said seat assembly so as to permit movement of said hip-limiting assembly out of the way for a patient on said chair to be shifted laterally off the seat assembly of said chair.

40. A chair for handicapped individuals comprising a seat assembly and an adjustable hip-limiting assembly at each lateral side of said seat assembly, each said hip-limiting assembly comprising a foundation member mounted to said seat assembly, a hip pad on a hip pad frame, and an adjustable link between said foundation member and said hip pad frame for varying the distance of the hip pad from the foundation member, said chair additionally including a leg assembly for mounting at each lateral side of said seat assembly, each said leg assembly comprising a leg rod, a removable and adjustable foot rest on said leg rod, and a removable and adjustable calf pad mounted on said leg rod, wherein said calf pad includes a mounting block having a grooved recess and a hook along one edge of the recess, and wherein said leg rod includes a longitudinal slot into which said hook of said mounting block extends when said calf pad is mounted on said leg rod in a manner causing said leg rod to be lodged in said grooved recess of said mounting block.

* * * * *

UNITED STATES PATENT AND TRADEMARK OFFICE

CERTIFICATE OF CORRECTION

PATENT NO. : 6,203,106 B1
DATED : March 20, 2001
INVENTOR(S) : Charles H. Nearing et al.

It is certified that error appears in the above-identified patent and that said Letters Patent is hereby corrected as shown below:

Column 3,
Line 13, change "tilt-able" to -- tiltable --.

Column 9,
Line 46, change "winged" to -- Winged --.

Column 10,
Line 9, change "on" to -- On --.

Column 15,
Line 36, change "adjustable" to -- adjustably --.
Line 41, change "an" at first occurrence to -- and --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*